US011610601B2

(12) United States Patent
Wang et al.

(10) Patent No.: US 11,610,601 B2
(45) Date of Patent: Mar. 21, 2023

(54) METHOD AND APPARATUS FOR DETERMINING SPEECH PRESENCE PROBABILITY AND ELECTRONIC DEVICE

(71) Applicant: CHINA ACADEMY OF TELECOMMUNICATIONS TECHNOLOGY, Beijing (CN)

(72) Inventors: Fabing Wang, Beijing (CN); Min Liang, Beijing (CN)

(73) Assignee: CHINA ACADEMY OF TELECOMMUNICATIONS TECHNOLOGY, Beijing (CN)

( * ) Notice: Subject to any disclaimer, the term of this patent is extended or adjusted under 35 U.S.C. 154(b) by 1282 days.

(21) Appl. No.: 16/070,584

(22) PCT Filed: Dec. 27, 2016

(86) PCT No.: PCT/CN2016/112323
§ 371 (c)(1),
(2) Date: Jul. 17, 2018

(87) PCT Pub. No.: WO2017/128910
PCT Pub. Date: Aug. 3, 2017

(65) Prior Publication Data

US 2022/0301582 A1 Sep. 22, 2022

(30) Foreign Application Priority Data

Jan. 25, 2016 (CN) ..... 201610049402.X

(51) Int. Cl.
*G10L 25/78* (2013.01)
*G10L 21/0232* (2013.01)

(52) U.S. Cl.
CPC ..... *G10L 25/78* (2013.01); *G10L 21/0232* (2013.01)

(58) Field of Classification Search
CPC . G10L 25/78; G10L 21/0232; G10L 21/0216; G10L 25/84; G10L 21/0224; G10L 21/0208
See application file for complete search history.

(56) References Cited

U.S. PATENT DOCUMENTS

2006/0009225 A1* 1/2006 Herre ..... G10L 19/008 455/450
2007/0021958 A1* 1/2007 Visser ..... G10L 25/78 704/226

(Continued)

FOREIGN PATENT DOCUMENTS

CN 101510426 A 8/2009
CN 101790752 A 7/2010
CN 103646648 A 3/2014

OTHER PUBLICATIONS

International Search Report for PCT/CN2016/112321, dated Mar. 29, 2017, and its English translation provided by WIPO.

(Continued)

*Primary Examiner* — Michael Colucci
(74) *Attorney, Agent, or Firm* — Ladas & Parry, LLP

(57) ABSTRACT

A method and apparatus for determining a speech presence probability and an electronic device are provided. According to present disclosure, a metric parameter of a signal to noise ratio of a signal of a first channel and a metric parameter of a signal power level difference between the first channel and the second channel are introduced in determining the speech presence probability, the normalization and non-linear transformation processing is performed on the above-mentioned metric parameters, and the speech presence probability is obtained by fitting the product term and a first power term of a power exponent of the above-mentioned parameters. Therefore, the calculation amount of calculating the speech presence probability is reduced, the calculation result has (Continued)

good robustness to parameter fluctuations, and the disclosure can be widely applied to various application scenarios of dual-microphone speech enhancement systems.

17 Claims, 4 Drawing Sheets

(56) References Cited

U.S. PATENT DOCUMENTS

| | | | | |
|---|---|---|---|---|
| 2008/0247565 | A1* | 10/2008 | Elko | H04S 3/002 381/92 |
| 2009/0089053 | A1 | 4/2009 | Wang et al. | |
| 2012/0121100 | A1* | 5/2012 | Zhang | H04R 1/245 381/71.1 |
| 2012/0263317 | A1* | 10/2012 | Shin | G10L 21/0224 381/94.7 |
| 2014/0067386 | A1 | 3/2014 | Zhang et al. | |
| 2015/0221322 | A1 | 8/2015 | Iyengar et al. | |
| 2018/0122399 | A1* | 5/2018 | Janse | G10L 21/0232 |

OTHER PUBLICATIONS

Written Opinion for PCT/CN2016/112323, dated Mar. 29, 2017, and its English translation provided by Goole Translate.

* cited by examiner

METHOD AND APPARATUS FOR DETERMINING SPEECH PRESENCE PROBABILITY AND ELECTRONIC DEVICE

CROSS-REFERENCE TO RELATED APPLICATIONS

The present application is the U.S. national phase of PCI Application PCT/CN2016/112323 filed on Dec. 27, 2016 which claims priority to the Chinese patent application No. 201610049402.X, filed with the Chinese State Intellectual Property Office on Jan. 25, 2016, the disclosures of which sire incorporated herein by reference in their entireties.

FIELD

The disclosure relates to the field of speech signal processing, and in particular, to a method and apparatus for determining a speech presence probability and an electronic device.

BACKGROUND

In a normal speech call, the user is in a non-speaking state such as pause/listen for about 50% of the period of time. In the speech enhancement system in the related art, a speech inactive segment is recognized through a speech activity detection (VAD) algorithm, and the statistical characteristics of the environmental noise is estimated and updated for the segment. With most of the current VAD technologies, the binary decisions whether a speech is activated or not is made by calculating parameters such as the zero-cross rate or short-term energy of the time waveform of a speech signal and comparing the parameters with the predetermined thresholds. However, misjudgment (that is, determining a speech segment as a non-speech segment or a determining a non-speech segment as a speech segment) often occurs with such a simple binary decision method, thereby affecting the accuracy of estimation of the statistical parameters of the environmental noise, and reducing the quality of the speech enhancement system.

In order to overcome the limitation of VAD, a soft decision technology of VAD is proposed. In the VAD soft-decision technology, first a speech presence probability (SPP) or speech absence probability (SAP) is calculated, and then SPP or SAP is used to estimate the statistical information of noise. However, for the dual-microphone speech enhancement system, most of the methods for calculating the speech presence probability in the related art have the disadvantages of a large amount of computation, sensitivity to parameter fluctuations, and the fact that the speech presence probability of the speech inactive segment does not approach zero.

SUMMARY

The technical problem to be solved according to embodiments of the disclosure is to provide a method and apparatus for determining a speech presence probability and an electronic device, which have advantages of low computational complexity and good robustness to parameter fluctuations, satisfy the constraint that the speech presence probability of speech inactive segments approaches zero, and can be widely applied to various dual-microphone speech enhancement systems.

In order to solve the above-mentioned technical problem, a method for determining a speech presence probability is provided according to an embodiment of the disclosure, which is applied to a first microphone and a second microphone configured with an End-fire structure. The method includes: calculating a first metric parameter and a second metric parameter according to a signal of a first channel collected by the first microphone and a signal of a second channel collected by the second microphone, wherein the first metric parameter is a signal to noise ratio of the signal of the first channel, and the second metric parameter is a signal power level difference between the first channel and the second channel; performing normalization and non-linear transformation processing on the first metric parameter and the second metric parameter respectively to obtain a third metric parameter and a fourth metric parameter; and calculating a speech presence probability according to the third metric parameter, the fourth metric parameter, and a predetermined formula for calculating a speech presence probability, wherein the calculating formula is obtained by fitting the product term and a first power term of a binary power exponent of the third metric parameter and the fourth metric parameter and normalizing the fitting coefficient.

Optionally, in the above-described solution, the calculation of the first metric parameter includes: calculating the first metric parameter using the following formula:

$$M_{SNR}(n, k) = \frac{\xi_1(n, k)}{\xi_0(k)}$$

where $M_{SNR}(n, k)$ represents the first metric parameter, $\xi_1(n, k)$ represents a priori signal to noise ratio of the k-th frequency component of the n-th frame signal of the first channel, and $\xi_0(k)$ represents a preset reference value for the signal to noise ratio of the k-th frequency component.

Optionally, in the above-described solution, the calculation of the second metric parameter includes: calculating the second metric parameter using the following formula:

$$M_{PLD}(n, k) = \frac{\Phi_{y_1y_1} - \Phi_{y_2y_2}}{\Phi_{y_1y_1} + \Phi_{y_2y_2}}$$

where $M_{PLD}(n, k)$ represents the second metric parameter, $\Phi_{y1y1}$ represents a signal power spectral density of the k-th frequency component of the n-th frame signal of the first channel, and $\Phi_{y2y2}$ represents a signal power spectral density of the k-th frequency component of the n-th frame signal of the second channel.

Optionally, in the above-described solution, the normalization and non-linear transformation process includes: updating a value of the parameter to be processed to obtain an intermediate parameter, wherein the value is updated to be 1 in a case that the value exceeds the interval [0, 1], otherwise the value remains unchanged, and the parameter to be processed is the first metric parameter or the second metric parameter; and performing piecewise linear transformation on the intermediate parameter to obtain a final parameter, wherein the final parameter is a piecewise linear function of the intermediate parameter, and a slope of a section close to the center of the range of the intermediate parameter is greater than a slope of a section far away from the center of the range of the intermediate parameter, the final parameter is the third metric parameter or the fourth metric parameter.

Optionally, in the above-described solution, a formula for calculating the speech presence probability is as follows:

$$P_1=c(aM'_{SNR}+(1-a)M'_{PLD})+(1-c)M'_{SNR}M'_{PLD}$$

where $P_1$ represents the speech presence probability of the k-th frequency component of the n-th frame signal, $M'_{SNR}$ represents the third metric parameter, and $M'_{PLD}$ represents the fourth metric parameter, and both a and c are fitting coefficients with a range of [0,1].

Optionally, in the above-described solution, values of the fitting coefficients a and c are preset fixed values.

Optionally, in the above-described solution, the value of the fitting coefficient a is preset according to the type of environmental noise; and the value of the fitting coefficient c is increased with a decrease in the difference between the $M'_{SNR}$ and the $M'_{PLD}$.

In the above-described solution, the value of the fitting coefficient c is calculated according to any of the following formulas:

$$c = \frac{(M'_{PLD} + M'_{SNR} - 1)^2}{(M'_{PLD} + M'_{SNR} - 1)^2 + (M'_{PLD} - M'_{SNR})^2};$$

$$c = 1 - |M'_{PLD} - M'_{SNR}|.$$

An apparatus for determining a speech presence probability is provided according to an embodiment of the disclosure, which is applied to a first microphone and a second microphone configured with an End-fire structure, and includes: a collection unit for calculating a first metric parameter and a second metric parameter according to a signal of a first channel collected by the first microphone and a signal of a second channel collected by the second microphone, wherein the first metric parameter is a signal to noise ratio of the signal of the first channel, and the second metric parameter is a signal power level difference between the first channel and the second channel; a conversion unit for performing normalization and non-linear transformation processing on the first metric parameter and the second metric parameter respectively to obtain a third metric parameter and a fourth metric parameter; and a calculation unit for calculating a speech presence probability according to the third metric parameter, the fourth metric parameter, and a predetermined formula for calculating a speech presence probability, wherein the calculating formula is obtained by fitting the product term and a first power term of a binary power exponent of the third metric parameter and the fourth metric parameter and normalizing the fitting coefficient.

Optionally, in the above-described solution, the collection unit is specifically used for: calculating the first metric parameter using the following formula:

$$M_{SNR}(n, k) = \frac{\xi_1(n, k)}{\xi_0(k)}$$

where $M_{SNR}(n, k)$ represents the first metric parameter, $\xi_1(n, k)$ represents a priori signal to noise ratio of the k-th frequency component of the n-th frame signal of the first channel, and $\xi_0(k)$ represents a preset reference value for the signal to noise ratio of the k-th frequency component.

Optionally, in the above-described solution, the collection unit is specifically used for: calculating the second metric parameter using the following formula:

$$M_{PLD}(n, k) = \frac{\Phi_{y_1y_1} - \Phi_{y_2y_2}}{\Phi_{y_1y_1} + \Phi_{y_2y_2}}$$

where $M_{PLD}(n, k)$ represents the second metric parameter, $\Phi_{y1y1}$ represents a signal power spectral density of the k-th frequency component of the n-th frame signal of the first channel, and $\Phi_{y2y2}$ represents a signal power spectral density of the k-th frequency component of the n-th frame signal of the second channel.

Optionally, in the above-described solution, the conversion unit is specifically used for: updating a value of the parameter to be processed to obtain an intermediate parameter, wherein the value is updated to be 1 in a case that the value exceeds the interval [0, 1], otherwise the value remains unchanged, and the parameter to be processed is the first metric parameter or the second metric parameter; and performing piecewise linear transformation on the intermediate parameter to obtain a final parameter, wherein the final parameter is a piecewise linear function of the intermediate parameter, and a slope of a section close to the center of the range of the intermediate parameter is greater than a slope of a section far away from the center of the range of the intermediate parameter, the final parameter is the third metric parameter or the fourth metric parameter.

Optionally, in the above-described solution, a formula for calculating the speech presence probability is as follows:

$$P_1=c(aM'_{SNR}+(1-a)M'_{PLD})+(1-c)M'_{SNR}M'_{PLD}$$

where $P_1$ represents the speech presence probability of the k-th frequency component of the n-th frame signal, $M'_{SNR}$ represents the third metric parameter, and $M'_{PLD}$ represents the fourth metric parameter, and both a and c are fitting coefficients with a range of [0,1].

Optionally, in the above-described solution, values of the fitting coefficients a and c are preset fixed values.

Optionally, in the above-described solution, the value of the fitting coefficient a is preset according to the type of environmental noise; and the value of the fitting coefficient c is increased with a decrease in the difference between the $M'_{SNR}$ and the $M'_{PLD}$.

Optionally, in the above-described solution, the value of the fitting coefficient c is calculated according to any of the following formulas:

$$c = \frac{(M'_{PLD} + M'_{SNR} - 1)^2}{(M'_{PLD} + M'_{SNR} - 1)^2 + (M'_{PLD} - M'_{SNR})^2};$$

$$c = 1 - |M'_{PLD} - M'_{SNR}|.$$

An electronic device is further provided according to an embodiment of the disclosure, which includes: a processor; and a memory, a first microphone, and a second microphone connected to the processor through a bus interface, wherein the first microphone and the second microphone are configured with an End-fire structure, and the memory is used for storing program and data used by the processor when performing operation, when the program and data stored in the memory is called and executed by the processor, the following functional modules are implemented: a collection unit for calculating a first metric parameter and a second metric parameter according to a signal of a first channel collected by the first microphone and a signal of a second channel collected by the second microphone, wherein the first metric parameter is a signal to noise ratio of the signal of the first channel, and the second metric parameter is a signal power level difference between the first channel and the second channel; a conversion unit for performing normalization and non-linear transformation processing on the first metric parameter and the second metric parameter respectively to obtain a third metric parameter and a fourth metric parameter; and a calculation unit for calculating a speech presence probability according to the third metric parameter, the fourth metric parameter, and a predetermined formula for calculating a speech presence probability, wherein the calculating formula is obtained by fitting the product term and a first power term of a binary power exponent of the third metric parameter and the fourth metric parameter and normalizing the fitting coefficient.

Compared with the related art, with the method and apparatus for determining the speech presence probability and the electronic device according to the embodiments of the present disclosure, the calculation amount of calculating the speech presence probability is greatly reduced and the constraint that the speech presence probability of the speech inactive segment approaches zero is satisfied, and the calculation results have good robustness to parameter fluctuations. In addition, the embodiments of the present disclosure can be used not only in the steady-state/quasi-steady-state noise field but also in the cases of transient noise and third-party speech interferences, and can be widely applied to various application scenarios of dual-microphone speech enhancement systems.

DETAILED DESCRIPTION

Figure 1:
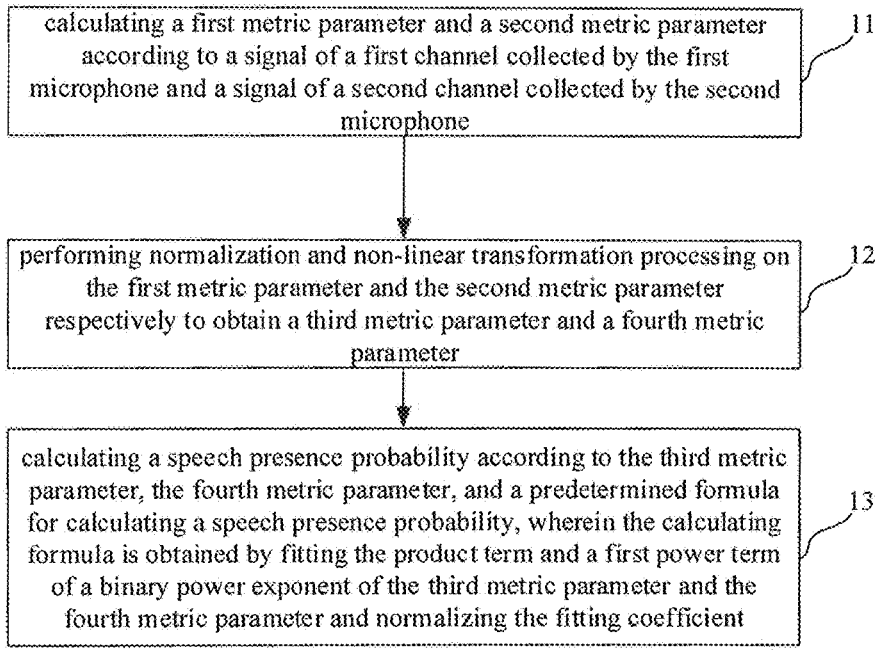
FIG. 1 is a schematic flowchart of a method for determining a speech presence probability according to an embodiment of the present disclosure.

In the following, embodiments of the disclosure are described in detail in conjunction with the drawings and specific embodiments, in order to make the technical problem to be solved in the disclosure, technical solutions and advantages more clear.

The method for determining a speech presence probability for a dual-microphone speech enhancement system in the related art cannot be well applied to the actual devices due to the shortcomings of a very large amount of computation and the sensitivity of the calculation result to parameter fluctuations, and the fact that the speech presence probability of the speech inactive segment does not approach zero. According to the embodiments of the present disclosure, two metric parameters are introduced and a new model for determining the speech presence probability is proposed, which can reduce the amount of computation and make the calculation result have good robustness to parameter fluctuations, and satisfy the constraint that the speech presence probability of speech inactive segments approaches zero.

Prior to introducing the embodiments of the present disclosure, in order to help better understanding the present disclosure, the calculation principle of the speech presence probability in the related art is introduced firstly.

Assuming that a signal collected by a microphone is:

$$y(n)=x(n)+d(n) \tag{1}$$

where x(n) is a user's speech signal, d(n) is a noise signal (including the sum of the environmental noise and other sound source interferences), and y(n) is the signal collected by the microphone.

The short-time Fourier transform is performed on the above formula (1) to obtain:

$$Y(n,k)=X(n,k)+D(n,k) \tag{2}$$

Assuming that the signal collected by the microphone has two states of hypothesis tests as follows:

H0 (that is, there is no speech signal): Y(n,k)=D(n,k)

H1 (that is, there is a speech signal): Y(n,k)=X(n,k)+D(n,k) (3).

The noise power spectrum is calculated using the soft decision method:

$$E[|D|^2|Y]=E[|D|^2|Y,H_0]p(H_0|Y)+E[|D|^2|Y,H_1]p(H_1|Y) \tag{4}$$

In the above formula (4), $p(H_1|Y)$ is a speech presence probability of the current time-frequency unit, and $p(H_0|Y)$ is a speech absence probability of the current time-frequency unit.

The Bayesian formula is used to obtain:

$$\begin{aligned} p(H_1 \mid Y(n,k)) &= \frac{p(Y(n,k) \mid H_1)p(H_1)}{p(Y(n,k))} \\ &= \frac{p(Y(n,k) \mid H_1)p(H_1)}{p(Y(n,k) \mid H_1)p(H_1) + p(Y(n,k) \mid H_0)p(H_0)} \\ &= \frac{1}{1+\frac{p(H_0)}{p(H_1)}\frac{p(Y(n,k) \mid H_0)}{p(Y(n,k) \mid H_1)}} \\ &\triangleq \frac{1}{1+q\Lambda} \end{aligned} \tag{5}$$

where $$q=\frac{p(H_0)}{p(H_1)}$$

is a ratio of the prior probability of the speech absence to that of the speech presence, $$\Lambda=\frac{p(y(n,k) \mid H_0)}{p(y(n,k) \mid H_1)}$$

is a ratio of a conditional probability of the k-th frequency of the n-th frame signal of the signal collected by the microphone. Assuming that amplitudes of frequencies satisfy a Gaussian distribution, the MMSE-STSA method is used to obtain:

$$\Lambda = (1+\xi(n,k))\exp\left(-\frac{\gamma(n,k)\xi(n,k)}{1+\xi(n,k)}\right) \quad (6)$$

In the above formula (6), □ξ(n, k), γ(n, k)are respectively a priori signal to noise ratio and a posteriori signal to noise ratio of the k-th frequency of the n-th frame signal of the signal collected by the microphone.

The above formula (5) is a single-channel SPP calculation method widely used in the related art.

In recent years, dual-microphone arrays have been widely used in mobile terminals to enhance the speech enhancement function. The dual-microphone arrays typically include a first microphone and a second microphone configured with an End-fire structure, with one microphone generally being positioned closer to the user's mouth. Considering that the above-mentioned method for calculating the speech presence probability is derived in a single microphone case, it cannot be completely applied to a multi-microphone system. For this reason, in the related art, the above-described method has been extended to the calculation of the presence probability of multi-microphone speech. Based on the assumption of the speech presence probability with the Gaussian model, a theoretical formula similar to the formulas (5) and (6) is derived as follows:

$$P(H_1 \mid Y) = \frac{1}{1+q(1+\xi(n,k))\exp\left(-\frac{\beta(n,k)}{1+\xi(n,k)}\right)} \quad (7)$$

Parameters ξ(n, k) and β(n, k) in the above formula (7) are replaced by the following multi-channel calculation formulas.

$$\xi(n,k) \triangleq tr[\Phi_{dd}^{-1}(n,k)\Phi_{xx}(n,k)] \quad (8)$$

$$\beta(n,k) \triangleq y^H(n,k)\Phi_{dd}^{-1}(n,k)\Phi_{xx}(n,k)\Phi_{dd}^{-1}(n,k)y(n,k) \quad (9)$$

where $$y(n,k)=[y_1(n,k)y_2(n,k)\ \ldots\ y_N(n,k)]^T,$$

$$X(n,k)=[x_1(n,k)x_2(n,k)\ \ldots\ x_N(n,k)]^T,$$

$$d(n,k)=[d_1(n,k)d_2(n,k)\ \ldots\ d_N(n,k)]^T;$$

The subscript N is the number of channels of a multi-microphone array (for example, a dual-microphone array). In a case of the dual-microphone array, N=2. $\Phi_{xx}$ and $\Phi_{dd}$ are the power spectral density matrices for a multi-channel speech signal and background noise, respectively, $\Phi_{xx}(n,k) \triangleq E\{x(n,k)x^{H(n,k)}\}=\Phi_{yy}(n,k)-\Phi_{dd}(n,k)$, $\Phi_{dd}(n,k) \triangleq E\{d(n,k)d^H(n,k)\}$, the expected values can be approximated through recursive calculation:

$$\Phi_y(n,k)=(1-\alpha_y)\Phi_{yy}(n-1,k)+\alpha_y y(n,k)y^H(n,k) \quad (10)$$

$$\Phi_{dd}(n,k)=(1-\alpha_d)\Phi_{dd}(n-1,k)+\alpha_d d(n,k)d^H(n,k) \quad (11)$$

where $0 \le \alpha_y \le 1$, $0 \le \alpha_d \le 1$.

A formula for calculating the presence probability of dual-channel speech can be obtained by applying the above formula (7) to a dual-microphone system.

However, if the above-mentioned theoretical formula is applied to a mobile terminal, there are problems such as a large amount of computation, and the sensitivity to parameters.

For the dual-microphone speech enhancement system, the SPP is calculated using formulas (7) to (9), involving a large number of matrix product and matrix inversion operations, which is impractical in a real-time processing speech enhancement system since too much computational resource is occupied. Secondly, in the actual application environment, the speech and noise signals are mostly unsteady signals, and the frequently occurring third-party interference sources are often transient signals. In this case, there is a large error between the estimated values and the actual values of the parameters ξ(n,k) and β(n,k). From the formula (7), the dependence relationship of the SPP on the parameters ξ(n,k) and β(n,k) is an exponential function, which is very sensitive to changes in parameters. The slight calculation errors of ξ(n,k) and β(n,k) may cause severe fluctuations in the calculated value of SPP, thereby affecting the overall performance of the speech enhancement system.

In addition, the theoretical formulas (5), (6) and (7) for the speech presence probability of a single-microphone array and a multi-microphone array are derived based on the Gaussian statistical model. There is a drawback that $$P(H_1 \mid Y) \to \frac{1}{1+q}$$

in a case that a priori signal to noise ratio of a time-frequency unit ξ(n,k)→0. This is in conflict with experience. When the signal to noise ratio approaches zero, no speech exists, that is, the speech presence probability should approach zero.

On the other hand, transient noise and third-party speech interferences are often encountered in the communication process of the mobile terminal, such noise sources and interference sources have similar or same time-varying characteristics as that of the speech. In calculating the speech presence probability using the above formula (7), this type of noise and interference may be determined as speech, leading to the failure of SPP calculation.

For the disadvantages of the above-described SPP estimation method, an SPP estimation method with low calculation complexity and insensitivity to parameter fluctuations is proposed according to an embodiment of the present disclosure so as to satisfy the following condition that: as ξ(n,k)→0, $P(H_1/Y)$→0, which is applied to the calculation of the speech presence probability of the dual-microphone array. The dual-microphone array includes a first microphone and a second microphone configured with an End-fire structure. It is assumed that a distance from the first microphone to the user's mouth is less than a distance from the second microphone to the user's mouth, that is, the first microphone is closer to the user's mouth than the second microphone.

Two parameters (hereinafter also referred to as a first metric parameter and a second metric parameter): $M_{SNR}(n,k)$, $M_{PLD}(n,k)$ (for the sake of simplicity, which are respectively recorded as $M_{SNR}$ and $M_{PLD}$ below) are defined in the embodiment of the present disclosure. The $M_{SNR}$ refers to a metric parameter for a signal to noise ratio (SNR) of a signal of a first channel, the $M_{PLD}$ refers to a metric parameter for a signal power level difference (PLD) between the first channel and the second channel, and the SPP is calculated with the two parameters.

Specifically, referring to FIG. 1, a method for determining a speech presence probability is provided according to an embodiment of the disclosure, which is applied to a first microphone and a second microphone configured with an End-fire structure. The method includes the following steps 11 to 13.

In step 11, a first metric parameter and a second metric parameter is calculated according to a signal of a first channel collected by the first microphone and a signal of a second channel collected by the second microphone, the first metric parameter is a signal to noise ratio of the signal of the first channel, and the second metric parameter is a signal power level difference between the first channel and the second channel.

The power level difference (the second metric parameter) between the dual-channel signals is used as a criterion for distinguishing the noise interference and the target speech, in combination with the SNR metric parameter (the first metric parameter), the speech presence probability of the dual-microphone system is calculated. For example, two parameters $M_{SNR}$ and $M_{PLD}$ respectively related to SNR and PLD are extracted in step 11 for the subsequent SPP calculation. $M_{SNR}$ is used as a criterion for detecting speech using the signal to noise ratio of the signal, and $M_{PLD}$ is used as a criterion for detecting near-field speech using different characteristics between the near-field target speech and the far-field noise interference.

In step 12, normalization and non-linear transformation processing is performed on the first metric parameter and the second metric parameter respectively to obtain a third metric parameter and a fourth metric parameter.

In step 12, the normalization and non-linear transformation processing can be performed on $M_{SNR}$ and $M_{PLD}$ by means of the piecewise linear transformation to obtain the third metric parameter (which may be recorded as $M'_{SNR}$) and the fourth metric parameter (which may be recorded as $M'_{PLD}$). The normalization and non-linear transformation process includes:

updating a value of the parameter to be processed to obtain an intermediate parameter, wherein the value is updated to be 1 in a case that the value exceeds the interval [0, 1], otherwise the value remains unchanged, and the parameter to be processed is the first metric parameter or the second metric parameter; and performing the piecewise linear transformation on the intermediate parameter to obtain a final parameter, wherein the final parameter is a piecewise linear function of the intermediate parameter, and a slope of a section close to the center of the range of the intermediate parameter is greater than a slope of a section far away from the center of the range of the intermediate parameter, the final parameter is the third metric parameter or the fourth metric parameter.

In step 13, a speech presence probability is calculated according to the third metric parameter, the fourth metric parameter, and a predetermined formula for calculating a speech presence probability, and the calculating formula is obtained by fitting the product term and a first power term of a binary power exponent of the third metric parameter and the fourth metric parameter and normalizing the fitting coefficient.

The formula for calculating the speech presence probability is to obtain a speech presence probability fitted by means of a quadratic function of the power level difference metric parameter (the fourth metric parameter) and the SNR metric parameter (the third metric parameter) after being normalized. For example, the calculation formula of the SPP may be fitted by using the first power term and the product term of $M'_{SNR}$ and $M'_{PLD}$. Then, in the specific calculation process, the weight of each term of the quadratic function may be adaptively adjusted according to the correlation between the power level difference metric parameter and the SNR metric parameter, that is, the fitting coefficient of the SPP calculation formula may be adjusted to make the calculation result more accurate. Of course, the values of the fitting coefficients a and c may be preset fixed values, for example, the values of the fitting parameters are preset according to the type of noise frequently appearing in the current application scene.

As can be seen, the above-described determining method according to the embodiment of the present disclosure has advantages of low computational complexity and good robustness to parameter fluctuations. In addition, most of the SPP calculation methods in the related art are aimed at steady-state/quasi-steady-state noise, and the calculation methods is prone to fail when the transient noise and third-party speech interferences are encountered. The SPP calculation method according to the embodiment of the present disclosure can be used not only in the steady-state/quasi-steady-state noise field but also in the cases of transient noise and third-party speech interferences, and can be widely applied to various application scenarios of dual-microphone speech enhancement systems.

In order to better understand the above-described steps, the embodiments of the present disclosure are further described through specific formulas and detailed textual descriptions below.

In the embodiment of the present disclosure, the first metric parameter is used to reflect the signal-to-noise ratio of the signal in the first channel. The specific metric parameter may be in various forms, which may be characterized by directly using a priori signal to noise ratio $\xi_1(n,k)$ of the signal of the first channel, or may also be characterized by using a ratio of the priori signal to noise ratio $\xi_1(n,k)$ of the signal of the first channel to a reference value (as shown in the following formula (12)). The second metric parameter is used to reflect the signal power level difference between the two channels, specifically, which may be characterized by a ratio of the signal power levels of the two channels (as shown in the following formula (13)), may also be characterized by a ratio of the power spectral density matrix (for example, $\Phi_{y2y2}/\Phi_{y1y1}$), or may also be characterized by a ratio of the difference to the sum value of the power spectral density of the two channels.

For a dual-microphone system, the target speech appears as a near-field signal, environmental noise and third-party interference appear as far-field signals. The signal power level difference between the first channel and the second channel of the dual microphone system can be used as an important criterion for distinguishing the near-field signal and the far-field signal, and used to detect the near-field target speech.

Different from the multi-channel SPP estimation method in the related art, according to the embodiment of the disclosure, the power level difference between the dual-channel signals is used as a criterion for distinguishing the noise interference and the target speech, in combination with the SNR metric parameter, the SPP of the dual-microphone system is calculated.

Figure 2:
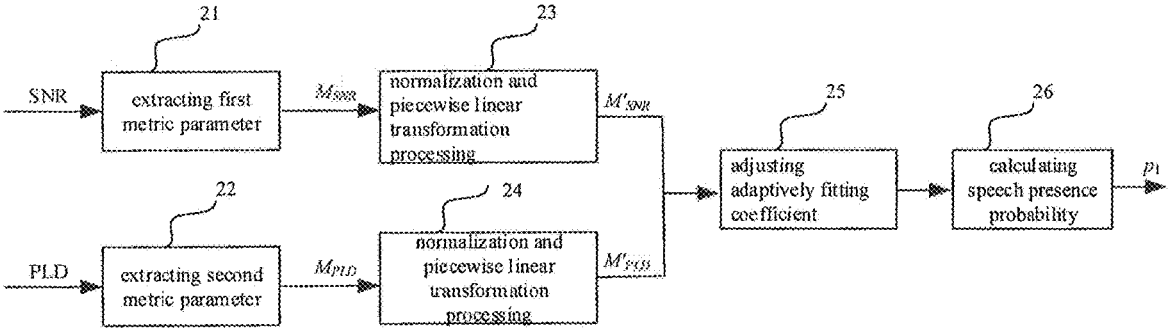
FIG. 2 is a schematic flowchart of a method for determining a speech presence probability according to an embodiment of the present disclosure.

In a case of ignoring the phase information between signals of the two microphones, the SPP has a complex functional relationship with the variables $M_{SNR}$ and $M_{PLD}$, which can be fitted using the power series of the two variables. In order to reduce the complexity of the algorithm, according to the embodiment of the present disclosure, first, the piecewise linear transformation is performed on the $M_{SNR}$ and $M_{PLD}$, then power series expansion is performed, and the first few items are acquired and their coefficients are fitted according to experience. As shown in FIG. 2, first, $M_{SNR}$ and $M_{PLD}$ are extracted (steps 21 and 23), and then the normalization and piecewise linear transformation processing are performed on the $M_{SNR}$ and $M_{PLD}$ to obtain $M'_{SNR}$ and $M'_{PLD}$ (steps 22 and 24). Then, before the SPP is calculated with weights according to the calculation formula, the fitting coefficient can be adjusted adaptively (step 25). Finally, the SPP is calculated with weights by using the product term and the first power term of the $M'_{SNR}$ and $M'_{PLD}$) (step 26) to obtain the calculation result of SPP (recorded as $p_1$).

An implementation way for extracting the SNR metric parameter $M_{SNR}$ and the power level difference metric parameter $M_{PLD}$ in the embodiment of the present disclosure is described below. The following formulas (12) and (13) are used as the characterization of the first and second metric parameters respectively, and the principle of other characterization is similar, which is not repeated any more to save space.

$$M_{SNR}(n, k) = \frac{\xi_1(n, k)}{\xi_0(k)} \tag{12}$$

$$M_{PLD}(n, k) = \frac{\Phi_{y_1y_1} - \Phi_{y_2y_2}}{\Phi_{y_1y_1} + \Phi_{y_2y_2}} \tag{13}$$

In the above formulas, $M_{SNR}(n, k)$ represents the first metric parameter, $\xi(n, k)$ represents a priori signal to noise ratio of the k-th frequency component of the n-th frame signal of the first channel, and $\xi_0$ (k) represents a preset reference value for the signal to noise ratio of the k-th frequency component. In the above formulas, $M_{PLD}(n, k)$ represents the second metric parameter, $\Phi_{y1y1}$ represents a signal power spectral density of the k-th frequency component of the n-th frame signal of the first channel, and $\Phi_{y2y2}$ represents a signal power spectral density of the k-th frequency component of the n-th frame signal of the second channel.

The first metric parameter, namely the signal to noise ratio parameter $M_{SNR}$, is extracted using the above formula (12). $\xi_0$ (k) may be preset according to frequency segmentation. For example, the speech frequency is grouped into three frequency bands of low frequency, intermediate frequency and high frequency, and a signal to noise ratio reference value is preset for each frequency band in the embodiment of the present disclosure.

$$\xi_0(k) = \begin{cases} \xi_L & 0 \le k < k_L \\ \xi_M & k_L \le k < k_H \\ \xi_H & k_H \le k < k_{FS} \end{cases} \tag{14}$$

Where $K_L$ represents the demarcation frequency between the low frequency band and the intermediate frequency band, $K_H$ represents the demarcation frequency between the intermediate frequency band and the high frequency band, and $K_{FS}$ represents the frequency corresponding to the upper boundary of the frequency band. $\xi_L$, $\xi_M$, $\xi_H$ are parameter values in these three frequency bands and can be determined according to experience. Examples are illustrated below.

Example 1: in a case that the embodiment of the present disclosure is applied to a narrowband speech signal, $k_L \in$ [800, 2000] Hz, $k_H \in$ [1500, 3000] Hz, correspondingly, the range of $\xi_L$, $\xi_M$, $\tau_H$ is within (1, 20).

Example 2: in a case that the embodiment of the present disclosure is applied to a narrowband speech signal, $k_L \in$ [800, 3000] Hz, $k_H \in$ [2500, 6000] Hz, correspondingly, the range of $\xi_L$, $\xi_M$, $\xi_H$ is within (1, 20)

Then, $M_{SNR}$ (n, k) at each frequency is calculated using the above formula (14).

The power level difference metric parameter $M_{PLD}$ can be extracted using the formula (13).

After the $M_{SNR}$ and $M_{PLD}$ are extracted, the $M'_{SNR}$ and $M'_{PLD}$ can be obtained through the nonlinear transformation process. A way of processing the non-linear transformation in the embodiment of the present disclosure is described below, that is, the normalization and piecewise linear transformation. Piecewise linear transformation means that the nonlinear characteristic curve is divided into several sections, and the characteristic curve in each section is approximately replaced by a straight-line section. This processing way is also called piecewise linearization, which can reduce the subsequent calculation complexity.

Figure 3:
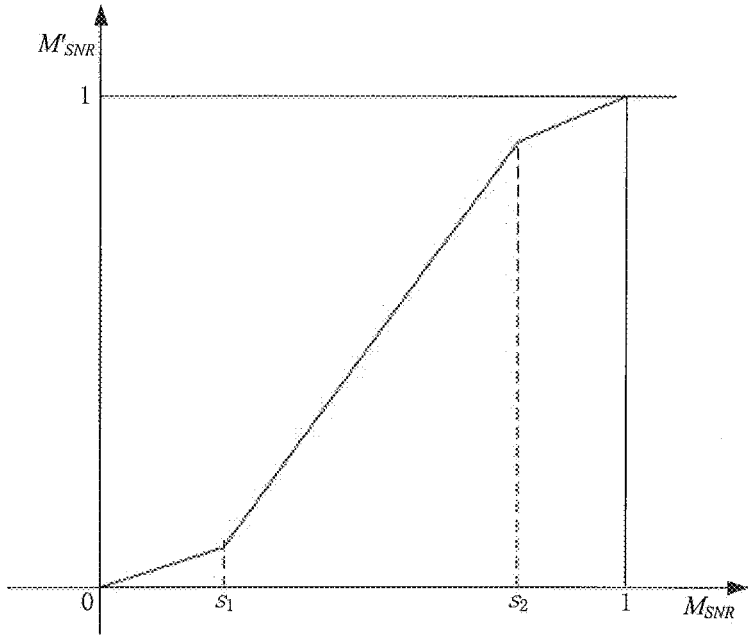
FIG. 3 is a schematic diagram of the piecewise linear transformation of a first metric parameter according to an embodiment of the present disclosure.

As can be seen from the above formula (7), if $M_{SNR} \to 0$, $p_1 \to 0$; if $M_{SNR} \to +\infty$, $p_1 \to 1$. In the embodiment of the present disclosure, the normalization and piecewise linear functions are used to process $M_{SNR}$ to obtain $M'_{SNR}$, and the function characteristics of the SPP depending on the parameter $M_{SNR}$ is fitted. As shown in FIG. 3, the range of $M'_{SNR}$ is within [0, 1].

Specifically, the range formula of $M_{SNR}$ is first normalized into an interval [0, 1] according to $M_{SNR}$=min ($M_{SNR}$, 1), and then the piecewise linear transformation is performed on $M_{SNR}$. The following formula (15) is illustrated by being divided into three sections as an example. Of course, the function may be divided into more or fewer sections in the embodiment of the disclosure.

$$M'_{SNR} = \begin{cases} k_1 * M_{SNR} & M_{SNR} < s_1 \\ k_1 * s_1 + k_2 * (M_{SNR} - s_1) & s_1 \le M_{SNR} < s_2 \\ k_1 * s_1 + k_2 * (s_2 - s_1) + k_3 * (M_{SNR} - s_2) & M_{SNR} \ge s_2 \end{cases} \tag{15}$$

As can be seen, the above-described step of performing normalization and non-linear transformation processing on the first metric parameter $M_{SNR}$ to obtain a third metric parameter $M'_{SNR}$ specifically includes: updating the first metric parameter according to the value of the first metric parameter, wherein the first metric parameter is updated to be 1 in a case that the first metric parameter exceeds the interval [0, 1], otherwise the first metric parameter remains unchanged; then performing piecewise linear transformation on the updated first metric parameter to obtain a third metric parameter, wherein the third metric parameter is a piecewise linear function of the first metric parameter. Considering the function characteristics of the SPP depending on the parameter $M_{SNR}$, a slope of a section close to the center of the range of the first metric parameter is greater than a slope of a section far away from the center of the range of the first metric parameter in several sections of the piecewise linear function. For example, for the formula (15), $k_2$ is greater than 1, both $k_1$ and $k_3$ are less than 1, and the values of $s_1$, $s_2$ and $s_3$ may be set based on empirical values.

Figure 4:
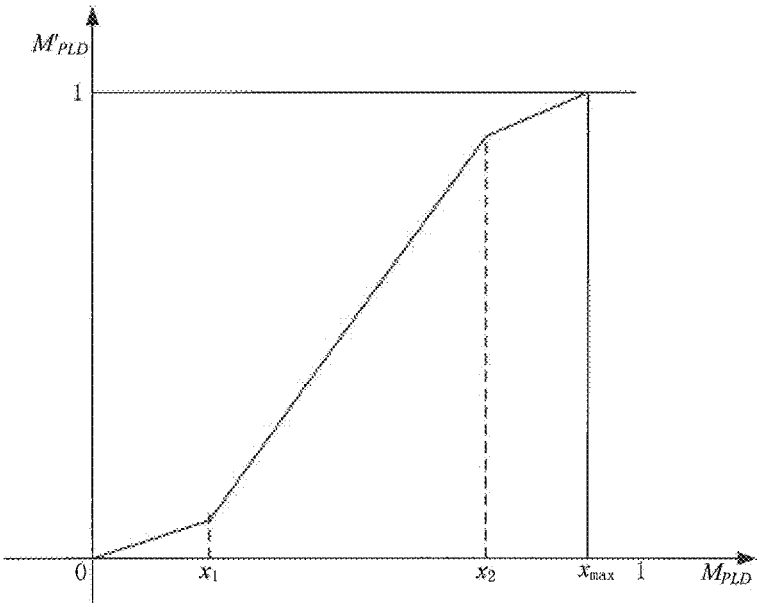
FIG. 4 is a schematic diagram of the piecewise linear transformation of a second metric parameter according to an embodiment of the present disclosure.

For the far-field noise and interference, $M_{PLD} \to 0$; $P_1=0$; for the near-field speech, $M_{PLD} \to 1$, $p_1 \to 1$. In the embodiment of the present disclosure, the piecewise linear function shown in FIG. 4 is used to normalize $M_{PLD}$. First, a parameter $x_{max}$ that is close to 1 is determined according to empirical data, and the value of $M_{PLD}$ is mapped into the interval [0, $x_{max}$] by using the formula of $M_{PLD}$=min($M_{PLD}$, $x_{max}$), then the piecewise linearization is performed using the formula (16), and the obtained range of $M_{PLD}$ is [0, 1]. The following formula (16) is illustrated by being divided into three sections as an example. Of course, the function may be divided into more or fewer sections in the embodiment of the disclosure.

$$M'_{PLD} = \begin{cases} t_1 * M_{PLD} & M_{PLD} < x_1 \\ t_1 * x_1 + t_2 * (M_{PLD} - x_1) & x_1 \le M_{PLD} < x_2 \\ t_1 * x_1 + t_2 * (x_2 - x_1) + t_3 * (M_{PLD} - x_2) & M_{PLD} \ge x_2 \end{cases} \quad (16)$$

As can be seen, the above-described step of performing normalization and non-linear transformation processing on the second metric parameter $M_{PLD}$ to obtain a fourth metric parameter $M'_{PLD}$ specifically includes: updating the second metric parameter according to the value of the second metric parameter, wherein the second metric parameter is updated to be 1 in a case that the second metric parameter exceeds the interval [0, 1], otherwise the second metric parameter remains unchanged; then performing piecewise linear transformation on the updated second metric parameter to obtain a fourth metric parameter, wherein the fourth metric parameter is a piecewise linear function of the second metric parameter. Considering the function characteristics of the SPP depending on the parameter $M_{PLD}$, a slope of a section close to the center of the range of the second metric parameter is greater than a slope of a section far away from the center of the range of the second metric parameter in several sections of the piecewise linear function. For example, for the formula (16), $t_2$ is greater than 1, both $t_1$ and $t_3$ are less than 1, and the values of $x_1$, $x_2$ and $x_3$ may be set based on empirical values.

As described above, the calculating formula for SPP as follows can be obtained by fitting the product term and a first power term of $M'_{SNR}$ and $M'_{PLD}$ to obtain SPP and normalizing the fitting coefficient:

$$P_1 = c(aM'_{SNR} + (1-\alpha)M'_{PLD}) + (1-c)M'_{SNR}M'_{PLD} \quad (17)$$

In the formula (17), there are two parameters a and c, and both the ranges of a and c are [0, 1]. In the embodiment of the disclosure, the value of c can be adaptively adjusted according to the correlation between $M_{SNR}$ and $M_{PLD}$, and the value of a can be adaptively adjusted according to the consistency characteristic of the microphone.

Theoretically, both $M'_{SNR}$ and $M'_{PLD}$ can be independently used as a criterion of VAD or independently calculate the SPP. Due to the influence of various factors, there is a deviation between the calculated value and the theoretical value. In particular, $M'_{SNR}$ has better adaptability to stationary noise and diffuse field noise; $M'_{PLD}$ has better adaptability to far-field non-stationary noise, transient noise and interference speech of third-party speakers.

Figure 5:
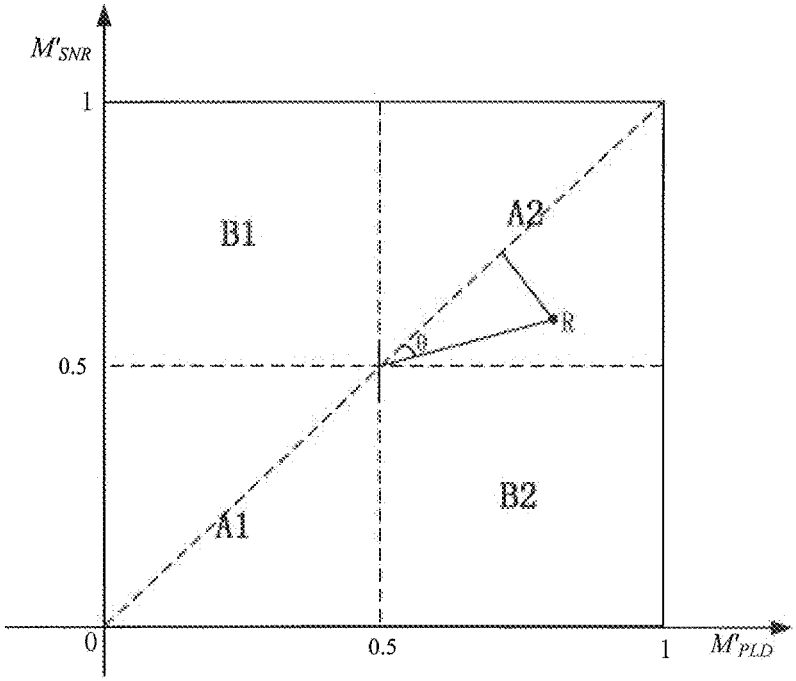
FIG. 5 is an exemplary schematic diagram of a way of determining a fitting coefficient according to an embodiment of the present disclosure.

As shown in FIG. 5, FIG. 5 shows the ranges of the parameters $M'_{SNR}$ and $M'_{PLD}$. The ranges of the $M'_{SNR}$ and $M'_{PLD}$ may be divided into four schematic zones. $M'_{PLD}$ is close to 0 and $M'_{SNR}$ is close to 0 in the zone $A_1$ in FIG. 5; $M'_{PLD}$ is close to 1 and $M'_{SNR}$ is close to 1 in the zone $A_2$; $M'_{PLD}$ is close to 0 and $M'_{SNR}$ is close to 1 in the zone $B_1$; $M'_{PLD}$ is close to 1 and $M'_{SNR}$ is close to 0 in the zone $B_2$.

In the zones $A_1$ and $A_2$, the two parameters are strongly correlated, the value of c is larger, and the linear part of the formula (17) is emphasized. In the zones $B_1$ and $B_2$, the two parameters are weakly correlated, the value of c is less, and the product term $M'_{SNR}M'_{PLD}$ of the formula (17) is emphasized. In the embodiment of the disclosure, the parameter c in the formula (17) may be adaptively adjusted according to the zones where $M_{SNR}$ and $M_{PLD}$ are distributed. Specifically, the value of the fitting coefficient c is increased with a decrease in the difference between $M'_{SNR}$ and $M'_{PLD}$.

The value policy of the parameter c is described by means of two examples below. It should be noted out that the embodiments of the present disclosure are not limited to the implementation way of these two examples.

Example 1: It is assumed that the current parameters $M'_{SNR}$ and $M'_{PLD}$ correspond to a reference point R in FIG. 5, that is, the coordinates of the reference point R is ($M'_{SNR}$, $M'_{PLD}$). Assuming that the angle included between the first line segment and the second ray is θ, $\cos^2(\nu)$ may be used as the value of parameter c, as shown in following formula (18), the first line segment has the point (0.5, 0.5) as the starting point and R as the end point, and the second ray has the point (0.5, 0.5) as the starting point and has an included angle of 45 degrees with the $M'_{PLD}$ axis.

$$c = \frac{(M'_{PLD} + M'_{SNR} - 1)^2}{(M'_{PLD} + M'_{SNR} - 1)^2 + (M'_{PLD} - M'_{SNR})^2} \quad (18)$$

Example 2: the value of c may be determined according to the following formula (19):

$$c = 1 - |M'_{PLD} - M'_{SNR}| \quad (19)$$

In the embodiment of the disclosure, the parameter a may be empirically determined in the range of $0 \leqslant a \leqslant 1$, or the value of a may be adjusted in advance according to the predicted noise type. For example, if the predicted noise is in the steady-state/quasi-steady state, the weight of $M'_{SNR}$ is increased, and the value of a is increased; if the noise is transient noise or third-party speech interference, the weight of $M'_{PLD}$ is increased, and the value of a is reduced. For example, a possible noise type in the current environment may be determined by the user based on the current environment, and the value of a is set according to the above noise type in the embodiment of the present disclosure.

After the values of the fitting coefficients a and c are determined, the speech presence probability is determined using the formula (17) in the embodiment of the disclosure. With the above formula (17), the computational complexity of SPP calculation is greatly reduced, and the speech presence probability is no longer an exponential function of the parameters ξ(n,k) and β(n,k) so that the calculation result has good robustness to parameter fluctuations. In addition, most of the SPP calculation methods in the related art are aimed at steady-state/quasi-steady-state noise, and the calculation methods is prone to fail when the transient noise and third-party speech interferences are encountered. The SPP calculation method according to the embodiment of the present disclosure can be used not only in the steady-state/quasi-steady-state noise field but also in the cases of transient noise and third-party speech interferences, and can be widely applied to various application scenarios of dual-microphone speech enhancement systems.

Figure 6:
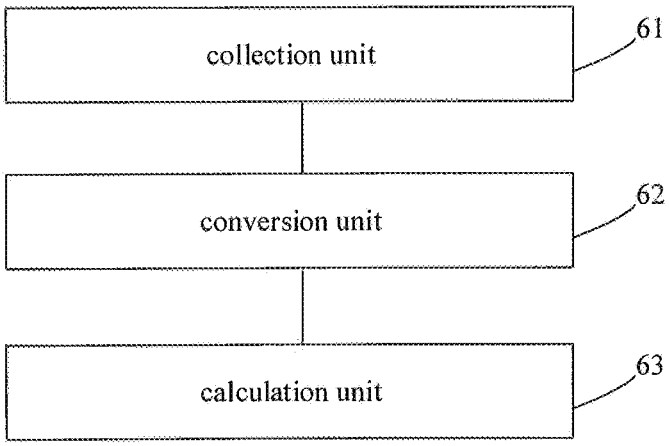
FIG. 6 is a schematic structural diagram of an apparatus for determining a speech presence probability according to an embodiment of the present disclosure.

Based on the method for determining a speech presence probability described above, a determining apparatus and an electronic device for implementing the above-described method are provided according to embodiments of the disclosure. Referring to FIG. 6, the determining apparatus according to the embodiment of the disclosure is applied to a first microphone and a second microphone configured with an End-fire structure, and the apparatus includes:

a collection unit 61 for calculating a first metric parameter and a second metric parameter according to a signal of a first channel collected by the first microphone and a signal of a second channel collected by the second microphone, wherein the first metric parameter is a signal to noise ratio of the signal of the first channel, and the second metric parameter is a signal power level difference between the first channel and the second channel;

a conversion unit 62 for performing normalization and non-linear transformation processing on the first metric parameter and the second metric parameter respectively to obtain a third metric parameter and a fourth metric parameter; and a calculation unit 63 for calculating a speech presence probability according to the third metric parameter, the fourth metric parameter, and a predetermined formula for calculating a speech presence probability, wherein the calculating formula is obtained by fitting the product term and a first power term of a binary power exponent of the third metric parameter and the fourth metric parameter and normalizing the fitting coefficient.

In the embodiment of the disclosure, the collection unit 61 is specifically used for:

calculating the first metric parameter using the following formula:

$$M_{SNR}(n, k) = \frac{\xi_1(n, k)}{\xi_0(k)}$$

where $M_{SNR}(n, k)$ represents the first metric parameter, $\xi_1(n, k)$ represents a priori signal to noise ratio of the k-th frequency component of the n-th frame signal of the first channel, and $\xi_0(k)$ represents a preset reference value for the signal to noise ratio of the k-th frequency component.

The collection unit 61 is further used for:

calculating the second metric parameter using the following formula:

$$M_{PLD}(n, k) = \frac{\Phi_{y_1y_1} - \Phi_{y_2y_2}}{\Phi_{y_1y_1} + \Phi_{y_2y_2}}$$

where $M_{PLD}(n, k)$ represents the second metric parameter, $\Phi_{y1y1}$ represents a signal power spectral density of the k-th frequency component of the n-th frame signal of the first channel, and $\Phi_{y2y2}$ represents a signal power spectral density of the k-th frequency component of the n-th frame signal of the second channel.

In the embodiment of the disclosure, the conversion unit 62 is specifically used for: updating a value of the parameter to be processed to obtain an intermediate parameter, wherein the value is updated to be 1 in a case that the value exceeds the interval [0, 1], otherwise the value remains unchanged, and the parameter to be processed is the first metric parameter or the second metric parameter; and performing piecewise linear transformation on the intermediate parameter to obtain a final parameter, wherein the final parameter is a piecewise linear function of the intermediate parameter, and a slope of a section close to the center of the range of the intermediate parameter is greater than a slope of a section far away from the center of the range of the intermediate parameter, the final parameter is the third metric parameter or the fourth metric parameter.

Optionally, in the In the embodiment of the disclosure, a formula for calculating the speech presence probability is as follows:

$$P_1 = c(aM'_{SNR} + (1-a)M'_{PLD}) + (1-c)M'_{SNR}M'_{PLD}$$

where $P_1$ represents the speech presence probability of the k-th frequency component of the n-th frame signal, $M'_{SNR}$ represents the third metric parameter, and $M'_{PLD}$ represents the fourth metric parameter, and both a and c are fitting coefficients with a range of [0,1].

Optionally, the values of the fitting coefficients a and c are preset fixed values.

Optionally, the values of the fitting coefficients a and c are determined based on $M'_{SNR}$ and $M'_{PLD}$. The value of the fitting coefficient a is determined according to the zone where ($M'_{SNR}$, $M'_{PLD}$) is located, and different zones correspond to different values.

The value of the fitting coefficient c is increased with a decrease in the difference between the $M'_{SNR}$ and the $M'_{PLD}$.

Optionally, the value of the fitting coefficient c is calculated according to any of the following formulas:

$$c = \frac{(M'_{PLD} + M'_{SNR} - 1)^2}{(M'_{PLD} + M'_{SNR} - 1)^2 + (M'_{PLD} - M'_{SNR})^2};$$

$$c = 1 - |M'_{PLD} - M'_{SNR}|.$$

Figure 7:
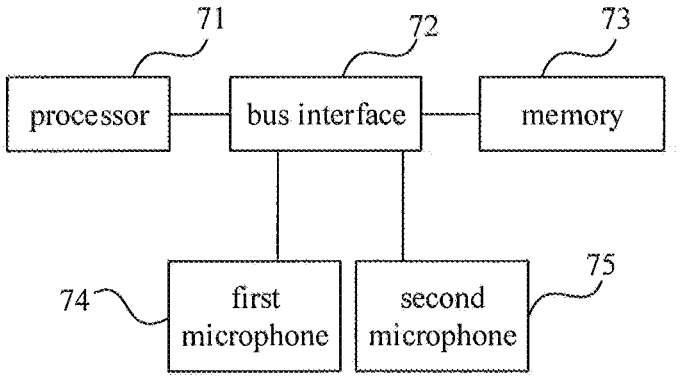
FIG. 7 is a schematic structural diagram of an electronic device according to an embodiment of the present disclosure.

Referring to FIG. 7, an electronic device according to an embodiment of the disclosure includes:

a processor 71; and a memory 73, a first microphone 74, and a second microphone 75 connected to the processor 71 through a bus interface 72. The first microphone 74 and the second microphone 75 are configured with an End-fire structure, and a distance from the first microphone 74 to the user's mouth is usually less than a distance from the second microphone 75 to the user's mouth. The memory 73 is used for storing program and data used by the processor 71 when performing operation, when the program and data stored in the memory 73 is called and executed by the processor 71, the following functional modules are implemented:

a collection unit for calculating a first metric parameter and a second metric parameter according to a signal of a first channel collected by the first microphone and a signal of a second channel collected by the second microphone, wherein the first metric parameter is a signal to noise ratio of the signal of the first channel, and the second metric parameter is a signal power level difference between the first channel and the second channel;

a conversion unit for performing normalization and non-linear transformation processing on the first metric parameter and the second metric parameter respectively to obtain a third metric parameter and a fourth metric parameter; and a calculation unit for calculating a speech presence probability according to the third metric parameter, the fourth metric parameter, and a predetermined formula for calculating a speech presence probability, wherein the calculating formula is obtained by fitting the product term and a first power term of a binary power exponent of the third metric parameter and the fourth metric parameter and normalizing the fitting coefficient.

The forgoing descriptions are only the optional embodiments of the present disclosure, and it should be noted that numerous improvements and modifications made to the present disclosure can further be made by those skilled in the art without being departing from the principle of the present disclosure, and those improvements and modifications shall fall into the scope of protection of the disclosure.

The invention claimed is:

1. A method for determining a speech presence probability, applied to a first microphone and a second microphone configured with an End-fire structure, comprising:

calculating a first metric parameter and a second metric parameter according to a signal of a first channel collected by the first microphone and a signal of a second channel collected by the second microphone, wherein the first metric parameter is a signal to noise ratio of the signal of the first channel, and the second metric parameter is a signal power level difference between the first channel and the second channel;

performing normalization and non-linear transformation processing on the first metric parameter and the second metric parameter respectively to obtain a third metric parameter and a fourth metric parameter; and calculating a speech presence probability according to the third metric parameter, the fourth metric parameter, and a predetermined formula for calculating a speech presence probability, wherein the calculating formula is obtained by fitting a product term and a first-order term of a binary power exponent of the third metric parameter and the fourth metric parameter and normalizing a fitting coefficient.

2. The method according to claim 1, wherein the calculating a first metric parameter comprises: calculating the first metric parameter using the following formula:

$$M_{SNR}(n, k) = \frac{\xi_1(n, k)}{\xi_0(k)}$$

where $M_{SNR}(n, k)$ represents the first metric parameter, $\xi_1(n,k)$ represents a priori signal to noise ratio of the k-th frequency component of the n-th frame signal of the first channel, and $\xi_0(k)$ represents a preset reference value for the signal to noise ratio of the k-th frequency component.

3. The method according to claim 2, wherein the calculating a second metric parameter comprises: calculating the second metric parameter using the following formula:

$$M_{PLD}(n, k) = \frac{\Phi_{y_1y_1} - \Phi_{y_2y_2}}{\Phi_{y_1y_1} + \Phi_{y_2y_2}}$$

where $M_{PLD}(n, k)$ represents the second metric parameter, $\Phi_{y1y1}$ represents a signal power spectral density of the k-th frequency component of the n-th frame signal of the first channel, and $\Phi_{y2y2}$ represents a signal power spectral density of the k-th frequency component of the n-th frame signal of the second channel.

4. The method according to claim 3, wherein the normalization and non-linear transformation process comprises:

updating a value of a parameter to be processed to obtain an intermediate parameter, wherein the value is updated to be 1 in a case that the value exceeds the interval [0, 1], otherwise the value remains unchanged, and the parameter to be processed is the first metric parameter or the second metric parameter; and performing piecewise linear transformation on the intermediate parameter to obtain a final parameter, wherein the final parameter is a piecewise linear function of the intermediate parameter, and a slope of a section close to the center of the range of the intermediate parameter is greater than a slope of a section far away from the center of the range of the intermediate parameter, the final parameter is the third metric parameter or the fourth metric parameter.

5. The method according to claim 4, wherein a formula for calculating the speech presence probability is as follows:

$$P_1 = c(aM'_{SNR} + (1-a)M'_{PLD}) + (1-c)M'_{SNR}M'_{PLD}$$

where $P_1$ represents the speech presence probability of the k-th frequency component of the n-th frame signal, $M'_{SNR}$ represents the third metric parameter, and $M'_{PLD}$ represents the fourth metric parameter, and both a and c are fitting coefficients with a range of [0,1].

6. The method according to claim 5, wherein values of the fitting coefficients a and c are preset fixed values.

7. The method according to claim 5, wherein the value of the fitting coefficient a is preset according to the type of environmental noise; and the value of the fitting coefficient c is increased with a decrease in the difference between the $M'_{SNR}$ and the $M'_{PLD}$.

8. The method according to claim 7, wherein the value of the fitting coefficient c is calculated according to any of the following formulas:

$$c = \frac{(M'_{PLD} + M'_{SNR} - 1)^2}{(M'_{PLD} + M'_{SNR} - 1)^2 + (M'_{PLD} - M'_{SNR})^2};$$

$$c = 1 - |M'_{PLD} - M'_{SNR}|.$$

9. An apparatus for determining, a speech presence probability, applied to a first microphone and a second microphone configured with an End-fire structure, comprising:

a collection unit configured to calculate a first metric parameter and a second metric parameter according to a signal of a first channel collected by the first microphone and a signal of a second channel collected by the second microphone, wherein the first metric parameter is a signal to noise ratio of the signal of the first channel, and the second metric parameter is a signal power level difference between the first channel and the second channel;

a conversion unit configured to perform normalization and non-linear transformation processing on the first metric parameter and the second metric parameter respectively to obtain a third metric parameter and a fourth metric parameter; and a calculation unit configured to calculate a speech presence probability according to the third metric parameter, the fourth metric parameter, and a predetermined formula for calculating a speech presence probability, wherein the calculating formula is obtained by fitting a product term and a first-order term of a binary power exponent of the third metric parameter and the fourth metric parameter and normalizing the fitting coefficient.

10. The apparatus according to claim 9, wherein the collection unit is specifically configured to: calculate the first metric parameter using the following formula:

$$M_{SNR}(n, k) = \frac{\xi_1(n, k)}{\xi_0(k)}$$

where $M_{SNR}(n, k)$ represents the first metric parameter, $\xi_1(n, k)$ represents a priori signal to noise ratio of the k-th frequency component of the n-th frame signal of the first channel, and $\xi_0(k)$ represents a preset reference value for the signal to noise ratio of the k-th frequency component.

11. The apparatus according to claim 10, wherein the collection unit is specifically configured to: calculate the second metric parameter using the following formula:

$$M_{PLD}(n, k) = \frac{\Phi_{y_1y_1} - \Phi_{y_2y_2}}{\Phi_{y_1y_1} + \Phi_{y_2y_2}}$$

where $M_{PLD}(n, k)$ represents the second metric parameter, $\Phi_{y1y1}$ represents a signal power spectral density of the k-th frequency component of the n-th frame signal of the first channel, and $\Phi_{y2y2}$ represents a signal power spectral density of the k-th frequency component of the n-th frame signal of the second channel.

12. The apparatus according to claim 11, wherein the conversion unit is specifically configured to:

update a value of a parameter to be processed to obtain an intermediate parameter, wherein the value is updated to be 1 in a case that the value exceeds the interval [0, 1], otherwise the value remains unchanged, and the parameter to be processed is the first metric parameter or the second metric parameter; and perform piecewise linear transformation on the intermediate parameter to obtain a final parameter, wherein the final parameter is a piecewise linear function of the intermediate parameter, and a slope of a section close to the center of the range of the intermediate parameter is greater than a slope of a section far away from the center of the range of the intermediate parameter, the final parameter is the third metric parameter or the fourth metric parameter.

13. The apparatus according to claim 12 wherein a formula for calculating the speech presence probability is as follows:

$$P_1 = c(aM'_{SNR} + (1-a)M'_{PLD}) + (1-c)M'_{SNR}M'_{PLD}$$

where $P_1$ represents the speech presence probability of the k-th frequency component of the n-th frame signal, $M'_{SNR}$ represents the third metric parameter, and $M'_{PLD}$ represents the fourth metric parameter, and both a and c are fitting coefficients with a range of [0,1].

14. The apparatus according to claim 13, wherein values of the fitting coefficients a and c are preset fixed values.

15. The apparatus according to claim 13, wherein the value of the fitting coefficient a is preset according to the type of environmental noise; and the value of the fitting coefficient c is increased with a decrease in the difference between the $M'_{SNR}$ and the $M'_{PLD}$.

16. The apparatus according to claim 15, wherein the value of the fitting coefficient c is calculated according to any of the following formulas:

$$c = \frac{(M'_{PLD} + M'_{SNR} - 1)^2}{(M'_{PLD} + M'_{SNR} - 1)^2 + (M'_{PLD} - M'_{SNR})^2};$$

$$c = 1 - |M'_{PLD} - M'_{SNR}|.$$

17. An electronic device, comprising:

a processor; and a memory, a first microphone, and a second microphone connected to the processor through a bus interface, wherein the first microphone and the second microphone are configured with an End-fire structure, and the memory is configured to store program and data used by the processor when performing operation, when the program and data stored in the memory is called and executed by the processor, the following functional modules are implemented;

a collection unit configured to calculate a first metric parameter and a second metric parameter according to a signal of a first channel collected by the first microphone and a signal of a second channel collected by the second microphone, wherein the first metric parameter is a signal to noise ratio of the signal of the first channel, and the second metric parameter is a signal power level difference between the first channel and the second channel;

a conversion unit configured to perform normalization and non-linear transformation processing on the first metric parameter and the second metric parameter respectively to obtain a third metric parameter and a fourth metric parameter; and a calculation unit configured to calculate a speech presence probability according to the third metric parameter, the fourth metric parameter, and a predetermined formula for calculating a speech presence probability, wherein the calculating formula is obtained by fitting a product term and a first-order term of a binary power exponent of the third metric parameter and the fourth metric parameter and normalizing a fitting coefficient.

* * * * *